US009657563B2

(12) United States Patent
Schuhrke et al.

(10) Patent No.: US 9,657,563 B2
(45) Date of Patent: May 23, 2017

(54) COMMUNICATION BETWEEN DOWNHOLE TOOL AND SURFACE LOCATION

(71) Applicant: Schlumberger Technology Corporation, Sugar Land, TX (US)

(72) Inventors: Laura Robin Schuhrke, Manvel, TX (US); Ronald James Spencer, Jr., Houston, TX (US); Peter Nellessen, Jr., Palm Beach Gardens, FL (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/415,999

(22) PCT Filed: Jul. 11, 2013

(86) PCT No.: PCT/US2013/049993

§ 371 (c)(1),
(2) Date: Jan. 20, 2015

(87) PCT Pub. No.: WO2014/011823

PCT Pub. Date: Jan. 16, 2014

(65) Prior Publication Data

US 2015/0226054 A1 Aug. 13, 2015

(51) Int. Cl.

| | |
|---|---|
| ***E21B 41/04*** | (2006.01) |
| ***E05C 1/12*** | (2006.01) |
| ***E21B 33/08*** | (2006.01) |
| ***E21B 33/038*** | (2006.01) |
| ***E21B 47/09*** | (2012.01) |

(Continued)

(52) U.S. Cl.
CPC ..... *E21B 47/09* (2013.01); *E21B 17/01* (2013.01); *E21B 34/06* (2013.01); *E21B 47/122* (2013.01); *E21B 47/14* (2013.01)

(58) Field of Classification Search
None
See application file for complete search history.

(56) References Cited

U.S. PATENT DOCUMENTS 4,527,425 A 7/1985 Stockton
6,150,954 A * 11/2000 Smith ..... E21B 47/122 340/853.3

(Continued)

OTHER PUBLICATIONS

International Search Report for PCT/US2013/049993 dated Oct. 13, 2013.

*Primary Examiner* — Matthew R Buck
*Assistant Examiner* — Douglas S Wood
(74) *Attorney, Agent, or Firm* — Tuesday Kaasch

(57) ABSTRACT

A system for communicating between a downhole tool and a surface location. The system may include a downhole tool disposed within a subsea riser. The downhole tool may include a device that actuates between first and second positions. An internal transducer may be coupled to the downhole tool and transmit a signal indicative of the position of the device. An external transducer may be positioned on an exterior of a riser. The external transducer may receive the signal from the internal transducer through the riser. A transponder may be positioned on an exterior of the riser and coupled to the external transducer. The transponder may transmit a signal to a surface location indicative of the position of the device.

19 Claims, 6 Drawing Sheets

(51) Int. Cl.

| | |
|---|---|
| ***E21B 47/12*** | (2012.01) |
| ***E21B 17/01*** | (2006.01) |
| ***E21B 34/06*** | (2006.01) |
| ***E21B 47/14*** | (2006.01) |

(56) References Cited

U.S. PATENT DOCUMENTS

| | | | | |
|---|---|---|---|---|
| 7,273,102 | B2 | 9/2007 | Sheffield | |
| 7,347,261 | B2 * | 3/2008 | Markel | E21B 47/0905 166/255.1 |
| 9,010,433 | B2 * | 4/2015 | Rios, III | E21B 33/038 166/338 |
| 2002/0050930 | A1 | 5/2002 | Thomeer et al. | |
| 2005/0115708 | A1 | 6/2005 | Jabusch | |
| 2009/0056936 | A1 | 3/2009 | McCoy, Jr. | |
| 2012/0000664 | A1 * | 1/2012 | Nas | E21B 33/085 166/344 |

* cited by examiner

COMMUNICATION BETWEEN DOWNHOLE TOOL AND SURFACE LOCATION

BACKGROUND

This application is a 371 National Phase of PCT/US2013/049993 filed Jul. 11, 2013, which claims the benefit of U.S. Provisional Application No. 61/670,467 filed Jul. 11, 2012, both of which are incorporated herein in their entirety.

A riser extends from a vessel down to the sea floor. A downhole tool, such as a subsea test tree, may be disposed within the riser proximate the sea floor. An umbilical cable or line is oftentimes used to transfer communication signals between the vessel and the downhole tool. The umbilical line is disposed within the riser and coupled to the downhole tool.

The umbilical lines may be hundreds of meters long and have a diameter from about 5 cm to about 15 cm. As such, the umbilical lines may take up a large amount of space on the deck of the vessel. Further, the umbilical lines are coupled to a tubing string and the downhole tool within the riser at predetermined locations, and this coupling process may take a significant amount of time. What is needed, therefore, is an improved system and method for communicating between a surface location and a downhole tool.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system for communicating between a downhole tool and a surface location is disclosed. The system may include a downhole tool disposed within a subsea riser. The downhole tool may include a device that actuates between first and second positions. An internal transducer may be coupled to the downhole tool and transmit a signal indicative of the position of the device. An external transducer may be positioned on an exterior of a riser. The external transducer may receive the signal from the internal transducer through the riser. A transponder may be positioned on an exterior of the riser and coupled to the external transducer. The transponder may transmit a signal to a surface location indicative of the position of the device.

A method for communicating between a downhole tool and a surface location is also disclosed. The method may include running a downhole tool into a subsea riser. The downhole tool may include a device that actuates between a first position and a second position. The device may include a valve or a latch. A signal may be transmitted from an internal transducer coupled to the downhole tool to an external transducer positioned on an exterior of the riser. The signal from the internal transducer may be indicative of the position of the device.

In another embodiment, the method may include running a downhole tool into a subsea riser. The downhole tool may include a device that actuates between a first position and a second position. An external transducer may be positioned about an exterior of the riser with a remotely operated vehicle. A signal may be transmitted from an internal transducer coupled to the downhole tool through the riser and to the external transducer. The signal from the internal transducer may be indicative of the position of the device.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
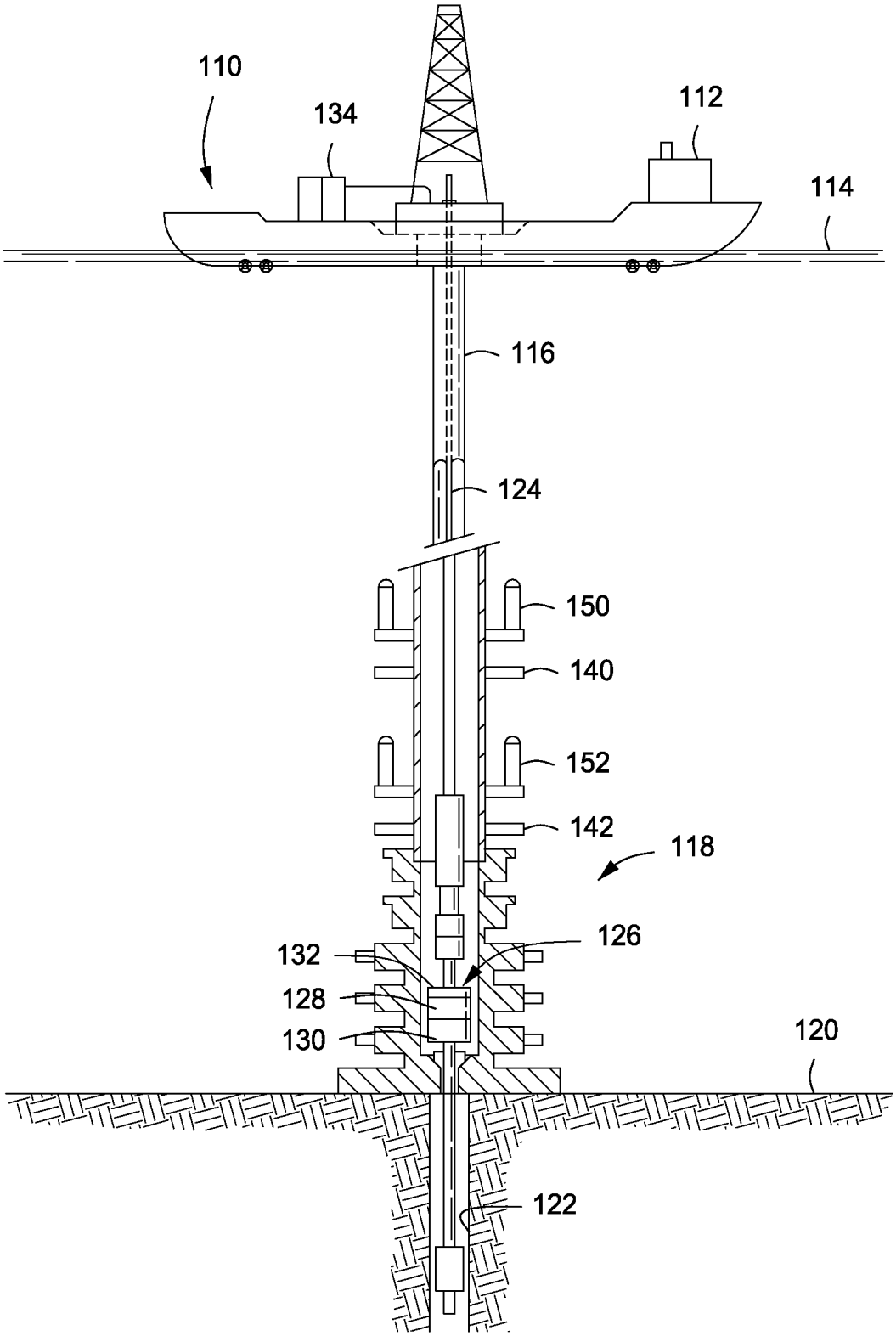
FIG. 1 depicts a schematic cross-section view of a riser extending from a vessel to the sea floor, according to one or more embodiments disclosed.

A system for communicating between a downhole tool 126 and a surface location 134 is disclosed. The system may include a downhole tool 126 disposed within a subsea riser 116. The downhole tool 126 may include one or more devices (three are shown 128, 130, 132) that actuates between first and second positions. An internal transducer 320 may be coupled to the downhole tool 126 and transmit a signal indicative of the position of the device 128, 130, 132. An external transducer 140 may be positioned on an exterior of the riser 116. The external transducer 140 may receive the signal from the internal transducer 320 through the riser 116. A transponder 150 may be positioned on an exterior of the riser 116 and coupled to the external transducer 140. The transponder 150 may transmit a signal to a surface location 134 indicative of the position of the device 128, 130, 132.

FIG. 1 depicts a schematic cross-section view of a riser 116 extending from a vessel 112 to the sea floor 120, according to one or more embodiments. A vessel 112 may be positioned at a surface location (e.g., on a water surface 114). Although the vessel 112 is illustrated as a ship, it may be appreciated that the vessel 112 may include any platform suitable for wellbore testing, intervention, completion, or production activities. For example, the vessel 112 may be or include a drilling rig.

A riser 116 may extend from the vessel 112 to a blowout preventer ("BOP") stack 118 positioned on the sea floor 120. As shown, a wellbore 122 has been drilled into the sea floor 120, and a tubing string 124 may extend from the vessel 112, through the riser 116 and the blowout preventer stack 118, and into the wellbore 122. The tubing string 124 includes an axial bore through which drilling fluids may be introduced into the wellbore 122 and/or through which hydrocarbons or other formation fluids may be produced from the wellbore 122 to the vessel 112.

A downhole tool 126 may be coupled to an end portion of the tubing string 124. The downhole tool 126 may be or include a drill bit, a rotary steerable tool, a stabilizer, an underreamer, a measurement while drilling tool, a logging while drilling tool, a subsea landing string, a subsea test tree ("SSTT"), combinations thereof, or the like. As shown, the downhole tool 126 includes a subsea test tree that is landed in the blowout preventer stack 118. The downhole tool 126 may include one or more devices that may be actuated between first and second positions. For example, the downhole tool 126 may include one or more valves 128, 130 and a latch 132 that may be actuated between first and second positions. The first valve 128 may act as a safety or control valve during testing of the wellbore 122. The second valve 130 may prevent fluid in the tubing string 124 from draining into the riser 116 when disconnected from the downhole tool 126. The latch 132 may connect the tubing string 124 to the downhole tool 126.

When the downhole tool 126 is a subsea test tree, the first valve 128 may be closed to prevent fluid flow from a lower portion of the tubing string 124 to an upper portion of the tubing string 124 when operating conditions fall outside a predetermined range. Once the first valve 128 is closed, the second valve 130 may be closed, thereby trapping pressure within the subsea test tree. The latch 132 may then disconnect the tubing string 124 from the subsea test tree, and the tubing string 124 may be pulled up to the vessel 112.

First and second external transducer arrays 140, 142 may be coupled to an exterior of the riser 116. The first and second external transducer arrays 140, 142 may be offset from one another by about 1 m to about 5 m, about 5 m to about 25 m, about 25 m to about 50 m, about 50 m to about 100 m, about 100 m to about 500 m, about 500 m to about 1000 m, or more. As shown, the second external transducer array 142 may be positioned proximate the blowout preventer stack 118. Although two external transducer arrays 140, 142 are shown, it may be appreciated that the number of external transducer arrays may range from 1, 2, 3, 4, or 5 to about 10, 20, 30, 40, 50, or more.

First and second transponders 150, 152 may also be coupled to an exterior of the riser 116. The first transponder 150 may be coupled to and/or in communication with the first external transducer 140, and the second transponder 152 may be coupled to and/or in communication with the second external transducer 142.

Figure 2:
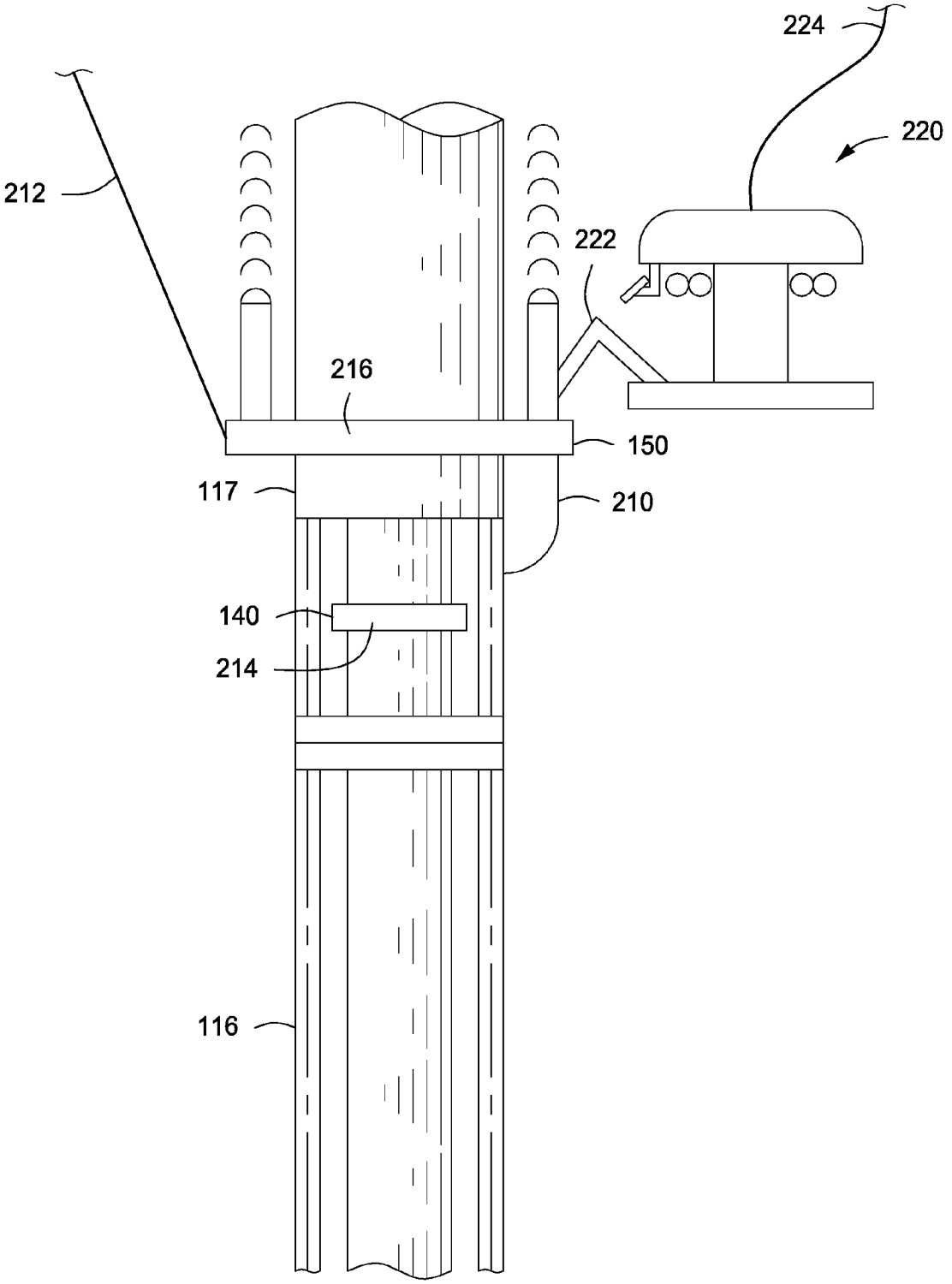
FIG. 2 depicts a schematic side view of a riser having an illustrative external transducer array coupled thereto, according to one or more embodiments disclosed.

FIG. 2 depicts a schematic side view of the riser 116 having the first external transducer array 140 coupled thereto, according to one or more embodiments. The external transducer array 140 may be adapted to convert a signal from one form of energy to another form of energy. More particularly, the external transducer array 140 may include a sensor that detects a signal in one form of energy and reports or transmits the signal in another form of energy, as discussed in more detail below with reference to FIG. 3. Illustrative energy types may include electrical, mechanical, electromagnetic, chemical, acoustic, thermal, combinations thereof, or the like.

One or more transponders 150 may also be coupled to the riser 116. As shown, the transponder 150 may be coupled to a buoyant portion 117 of the riser 116. The buoyant portion 117 of the riser 116 may be made of a material that is less dense than the riser 116 to prevent the riser 116 from collapsing due to the surrounding hydrostatic pressure. Although not shown, in another embodiment, the transponder 1 may be coupled to the "bare" riser 116.

The transponder 150 may be adapted to transmit a signal to a surface operator station 134 (FIG. 1) located on the vessel 112. The transponder 150 may be coupled to and in communication with the external transducer array 140 via a cable 210. As such, the transponder 150 may receive the signals from the external transducer array 140 via the cable 210 and transmit the signals to the surface operator station 134 on the vessel 112. In at least one embodiment, the signals transmitted by the transponder 150 may be wireless signals, such as acoustic pulses. In another embodiment, the transponder 150 may be coupled to the surface operator station via a cable 212, and the signals may be transmitted through the cable 212.

The external transducer array 140 and/or the transponder 150 may be clamped around the exterior of the riser 116. The clamps 214, 216 may magnetically attach or couple to the exterior of the riser 116. In at least one embodiment, the external transducer array 140 and/or the transponder 150 may be clamped around the riser 116 at the vessel 112 before the riser 116 is lowered toward the sea floor 120. In another embodiment, the external transducer array 140 and/or the transponder 150 may be clamped around the riser 116 by a remotely operated vehicle ("ROV") 220 after the riser 116 has been lowered from the vessel 112.

The remotely operated vehicle 220 may include one or more manipulators or arms 222 that are adapted to grasp and position components (e.g., the external transducer array 140 and/or the transponder 150) while underwater. The remotely operated vehicle 220 may also include a tether line 224 that extends up to the vessel 112. The movement of the remotely operated vehicle may be controlled through the tether line 224. In at least one embodiment, one or more signals may be transmitted from the remotely operated vehicle 220 to the vessel 112 through the tether line 224 and vice versa.

Figure 3:
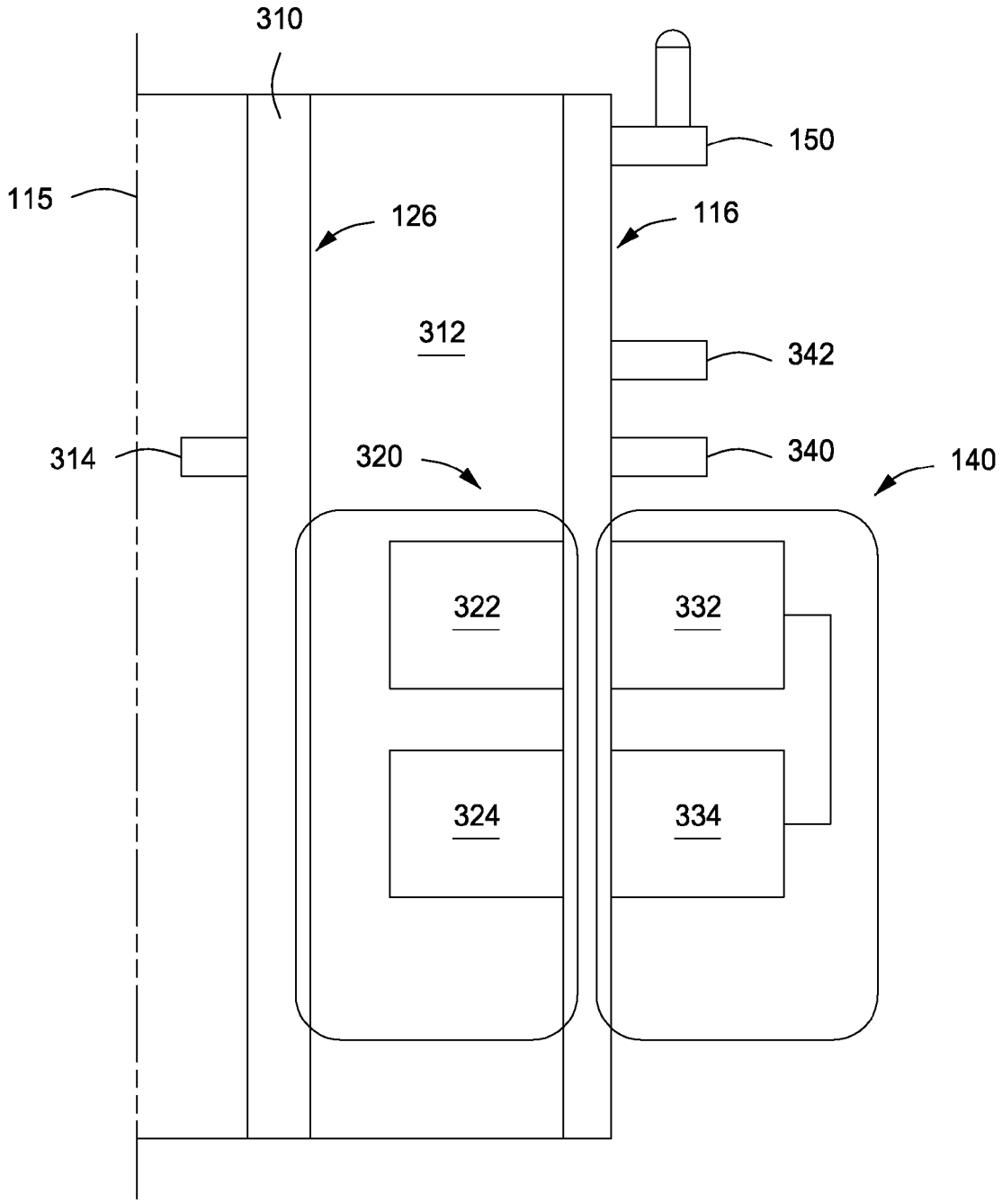
FIG. 3 depicts a partial schematic cross-section view of the riser and downhole tool shown in FIG. 1, according to one or more embodiments disclosed.

FIG. 3 depicts a partial schematic cross-section view of the riser 116 and the downhole tool 126, according to one or more embodiments. The downhole tool 126 may include a body or mandrel 310. The body 310 of the downhole tool 126 may be disposed radially-inward from the riser 116. The body 310 of the downhole tool 126 may have an outer diameter ranging from about 5 cm, about 10 cm, about 15 cm, or about 20 cm to about 25 cm, about 30 cm, about 35 cm, about 40 cm, or more. For example, the outer diameter may be from about 10 cm to about 20 cm, about 20 cm to about 30 cm, or about 18 cm to about 25 cm. The riser 116 may have an outer diameter ranging from about 20 cm, about 30 cm, about 40 cm, or about 50 cm to about 60 cm, about 70 cm, about 80 cm, about 90 cm, or more. For example, the outer diameter may be from about 30 cm to about 50 cm, about 50 cm to about 70 cm, or about 70 cm to about 90 cm.

An annulus 312 may be formed between the body 310 of the downhole tool 126 and the riser 116. The annulus 312 may have a fluid disposed therein. The fluid may have a pressure ranging from about 1 MPa, about 5 MPa, about 10 MPa, about 20 MPa, or about 30 MPa to about 50 MPa, about 75 MPa, about 100 MPa, about 125 MPa, about 150 MPa, or more. For example, the pressure may be from about 5 MPa to about 25 MPa, about 25 MPa to about 50 MPa, or about 50 MPa to about 100 MPa.

A sensor 314 may be coupled to and/or disposed within the downhole tool 126. The sensor 314 may be coupled to and in communication with the valves 128, 130 and/or the latch 132 (FIG. 1). The sensor 314 may be able to determine or "sense" when the valves 128, 130 are open or closed. In another embodiment, the sensor 314 may be able to determine or "sense" whether the latch 132 is coupling the tubing string 124 to the downhole tool 126 or whether the downhole tool 126 has been released from the tubing string 124.

An internal transducer array 320 may be coupled to the exterior of the downhole tool 126. The internal transducer array 320 may include one or more transducers (two are shown 322, 324). The transducers 322, 324 may be parallel to the centerline 115 of the riser 116 and axially offset from one another, as shown. In another embodiment, the transducers 322, 324 may be circumferentially offset from one another around exterior of the downhole tool 126.

The internal transducer array 320 may be coupled to and in communication with the sensor 314. As such, the internal transducer array 320 may be adapted to receive one or more signals from the sensor 314 that indicate the status of the valves 128, 130 and/or the latch 132.

As discussed above, the external transducer array 140 may be coupled to the exterior of the riser 116. The external transducer array 140 may include one or more transducers (two are shown 332, 334). The transducers 332, 334 may be parallel to the centerline 115 of the riser 116 and axially offset from one another, as shown. In another embodiment, the transducers 332, 334 may be circumferentially offset from one another around exterior of the downhole tool 126 and/or the interior of the riser 116. The transducers 332, 334 in the external transducer array 120 may be radially aligned with the transducers 322, 324 in the internal transducer array 320. This may allow the transducer arrays 140, 320 to communicate with one another through the riser 116.

An electronics package 340 may be coupled to the external transducer array 140 and/or the transponder 150. The electronics package 340 may process the signals transmitted from the external transducer array 140 to the transponder 150 and vice versa. For example, the electronics package 340 may convert analog signals from the external transducer array 140 to digital signals for the transponder 150 and vice versa.

A battery pack 342 may be coupled to the external transducer array 140, the electronics package 340, and/or the transponder 150. The battery pack 342 may provide localized power to the external transducer array 140, the electronics package 340, and/or the transponder 150.

FIGS. 4-7 depict schematic plan views of the clamp 214 with the external transducer array 140 being installed around the riser 116, according to one or more embodiments. The riser 116 may have one or more lines positioned thereabout. For example, the riser 116 may have a choke line 410, a kill line 412, a booster line 414, and one or more hydraulic lines 416, 418 positioned thereabout. The lines 410, 412, 414, 416, 418 may be spaced apart from the exterior of the riser 116 (i.e., in a radial direction) from about 1 cm, about 2 cm, about 3 cm, about 4 cm, or about 5 cm to about 6 cm, about 8 cm, about 10 cm, about 15 cm, about 20 cm, or more. For example, the lines 410, 412, 414, 416, 418 may be spaced apart from the exterior of the riser 116 from about 1 cm to about 15 cm, from about 2 cm to about 10 cm, or from about 5 cm to about 20 cm.

Figure 4:
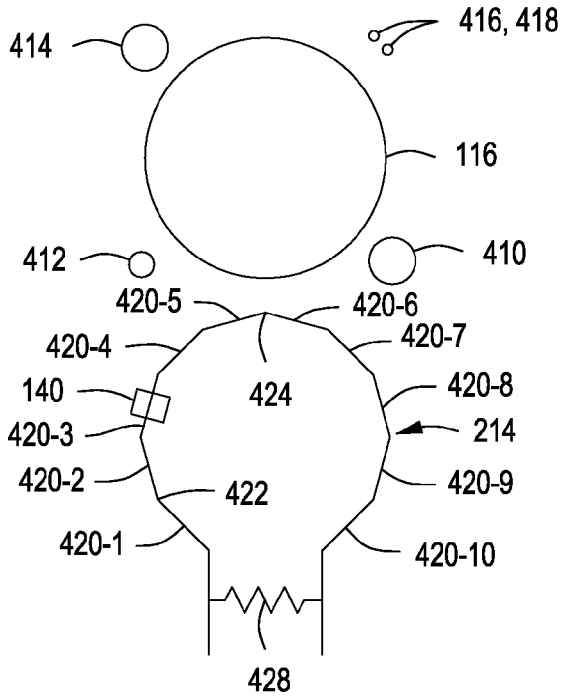
FIG. 4 depicts a schematic plan view of the clamp with the external transducer array prior to being installed around the riser, according to one or more embodiments disclosed.
Figure 5:
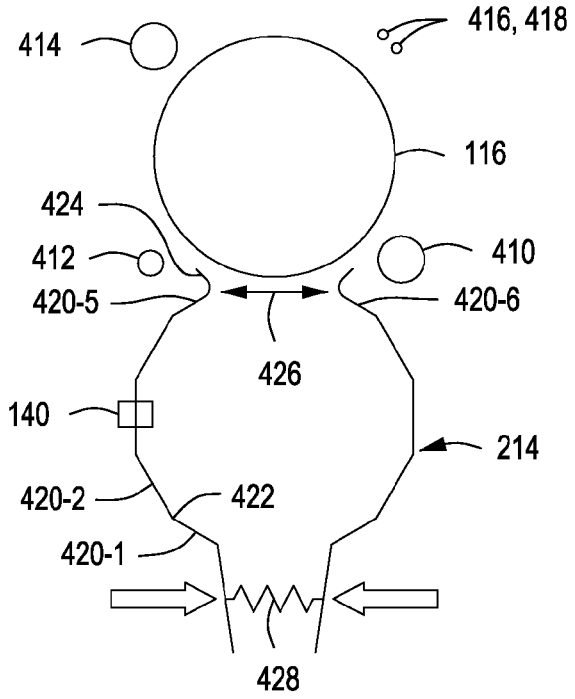
FIGS. 5 and 6 depict schematic plan views of the clamp with the external transducer array being installed around the riser, according to one or more embodiments disclosed.
Figure 6:
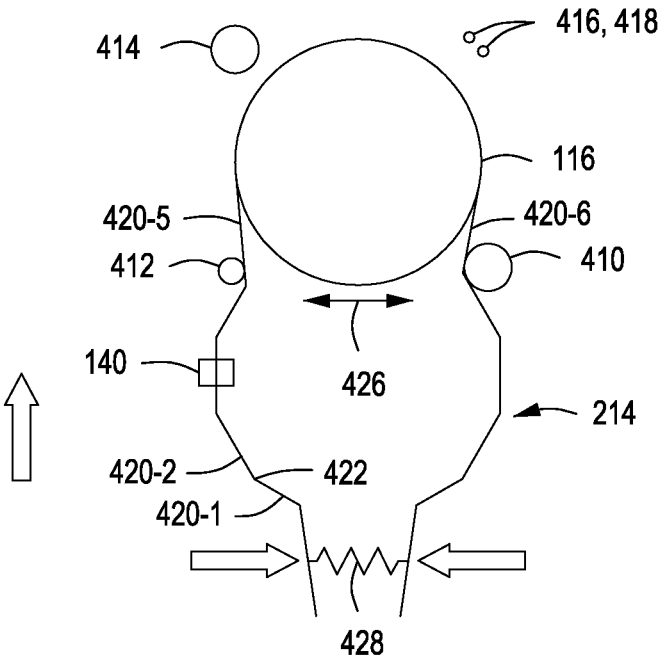

The clamp 214 may be arranged and designed to be installed around the riser 116 and radially-inward from the lines 410, 412, 414, 416, 418 (with respect to the longitudinal line extending through the riser 116). The clamp 214 may include a plurality of links or fingers 420 that are circumferentially offset from one another to at least partially form a ring. The external transducer array 140 may be coupled to or integral with at least one of the fingers 420. Each adjacent pair of fingers (e.g., 420-1, 420-2) may have a hinge 422 disposed therebetween to allow the fingers 420 to bend or flex with respect to one another. In place of one of the hinges 422, a clip 424 may be disposed between an adjacent pair of fingers (e.g., 420-5, 420-6). The clip 424 may be actuated from a closed position to an open position. In the closed position, the two fingers 420-5, 420-6 are secured together, as shown in FIG. 4. In the open position, the two fingers 420-5, 420-6 are adapted to move away from one another forming a gap 426 therebetween, as shown in FIGS. 5 and 6. The clamp 214 may also include a spring 428 for moving the two fingers 420-5, 420-6 away from one another to form the gap 426.

FIGS. 5 and 6 depict schematic plan views of the clamp 214 with the external transducer array 140 being installed around the riser 116, according to one or more embodiments. Installation may take place by an operator on the vessel 112 or by the remotely operated vehicle 220 (FIG. 2) underwater. The clip 424 may initially be in the closed position. The clip 424 may be actuated into the open position. The spring 428 may then be compressed, as shown in FIG. 5. In at least one embodiment, compression of the spring 428 may cause the clip 424 to actuate into the open position.

Once in the open position, the further compression of the spring 428 may cause the fingers 420-5, 420-6 to move away from one another forming the gap 426 therebetween. The gap 426 may be increased until the length of the gap 426 is equal to or greater than the outer diameter of the riser 116. When the gap 426 is equal to or greater than the outer diameter of the riser 116, the clamp 214 may be moved toward the riser 116, as shown in FIGS. 5 and 6.

Figure 7:
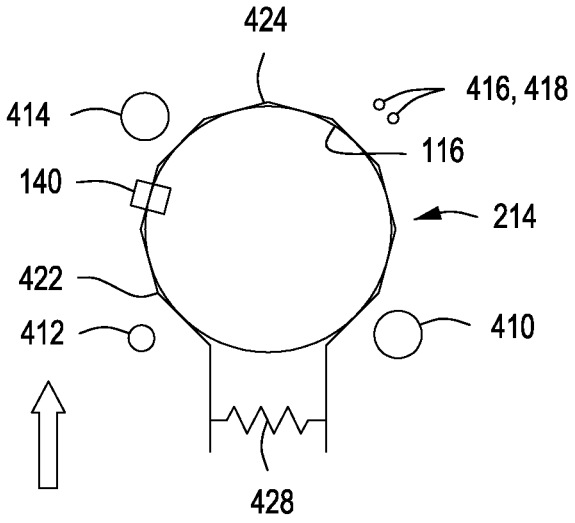
FIG. 7 depicts a schematic plan view of the clamp with the external transducer array after being installed around the riser, according to one or more embodiments disclosed.

FIG. 7 depicts a schematic plan view of the clamp 214 with the external transducer array 140 after being installed around the riser 116, according to one or more embodiments. Once the clamp 214 is positioned about the riser 116, the clip 424 may be actuated into the closed position to secure the clamp in place about the riser 116. As discussed above, this may be done by an operator on the vessel 112 or by the remotely operated vehicle 220 underwater. As shown in FIG. 7, once installed, the clamp 214 may be positioned radially between the riser 116 and the lines 410, 412, 414, 416, 418.

Referring to FIGS. 1-7, in operation, once the external transducers 140, 142 and the transponders 150, 152 have been secured to the riser 116, the tubing string 124 may be run in hole ("RIH," i.e., into the riser 116 and/or the wellbore 122). The downhole tool 126 (e.g., a subsea test tree) may be coupled to the tubing string 124 as the tubing string 124 is lowered through the riser 116.

As the downhole tool 126 is lowered through the riser 116, the sensor 314 may determine or sense the status of one or more devices in the downhole tool 126. For example, the sensor 314 may sense the position of the valves 128, 130 (i.e., open or closed). In another embodiment, the sensor 314 may sense whether the downhole tool 126 is coupled to the tubing string 124 via the latch 132. The data from the sensor 314 may be transmitted to the internal transducer array 320. As the downhole tool 126 (and the internal transducer array 320 coupled thereto) pass by the first external transducer array 140, the internal transducer array 320 may transmit one or more signals indicative of the data from the sensor 314 through the riser 116 and to the first external transducer array 140. For example, the signals may be acoustic signals.

The first external transducer array 140 may transmit one or more signals to the first transponder 150 indicative of the data from the sensor 314. In at least one embodiment, the signals may be processed or pre-processed by the electronics package (FIG. 3) prior to being transmitted to the first transponder 150. The first transponder 150 may transmit the signals to the surface operator station 134 on the vessel 112. More particularly, the first transponder 150 may transmit the signals to the surface operator station 134 via acoustic pulses. In another embodiment, the first transponder 150 may transmit the signals to the surface operator station via the cable 212.

The second external transducer array 142 may be positioned proximate the sea floor 120. For example, the downhole tool 126 may be a subsea test tree, and the second external transducer array 142 may be positioned proximate the blowout preventer stack 118. The downhole tool 126 may land in the blowout preventer stack 118. The sensor 314 may sense the position of the valves 128, 130 during the landing process or after the downhole tool 126 has landed in the riser ("LIR"). In another embodiment, the sensor 314 may sense whether the latch 132 is coupling the downhole tool 126 to the tubing string 124 or whether the latch 132 has released the downhole tool 126 from the tubing string 124 indicating that the downhole tool 126 has landed in the riser ("LIR"). The data from the sensor 314 may be transmitted to the internal transducer array 320. The internal transducer array 320 may transmit one or more signals indicative of the data from the sensor 314 through the riser 116 and to the second external transducer array 142.

The second external transducer array 142 may transmit the signals to the second transponder 152, and the second transponder 152 may transmit the signals to the surface operator station 134 on the vessel 112 as described above. The first and second transponders 150, 152 may use unique channels to differentiate the signals. For example, the signals may have different frequencies (or frequency bands), modulation schemes, device IDs, or the like. Thus, the status of the downhole tool 126 may be monitored at multiple locations within the riser 116 without the use of a communications umbilical line in the riser 116. The first and second external transducer arrays 140, 142 may also determine or sense the status of the downhole tool 126 as the downhole tool 126 is pulled out of the hole ("POOH," i.e., out of the riser 116 to the vessel 112).

In at least one embodiment, the remotely operated vehicle 220 may have an external transducer array coupled thereto (not shown). The remotely operated vehicle 220 may be adapted to position the external transducer array at any location along the riser 116 to receive the signals from the internal transducer array 320 as the downhole tool 126 moves through the riser 116. Once the signals are received, the remotely operated vehicle 220 may send the signals to the surface operator station 134 via spare conductors in the remotely operated vehicle's 220 tether line 224 and/or using spare channels in the remotely operated vehicle's 220 telemetry system. In another embodiment, the signals may be stored in a memory within the remotely operated vehicle 220 and accessed once the remotely operated vehicle 220 returns to the vessel 112.

Figure 8:
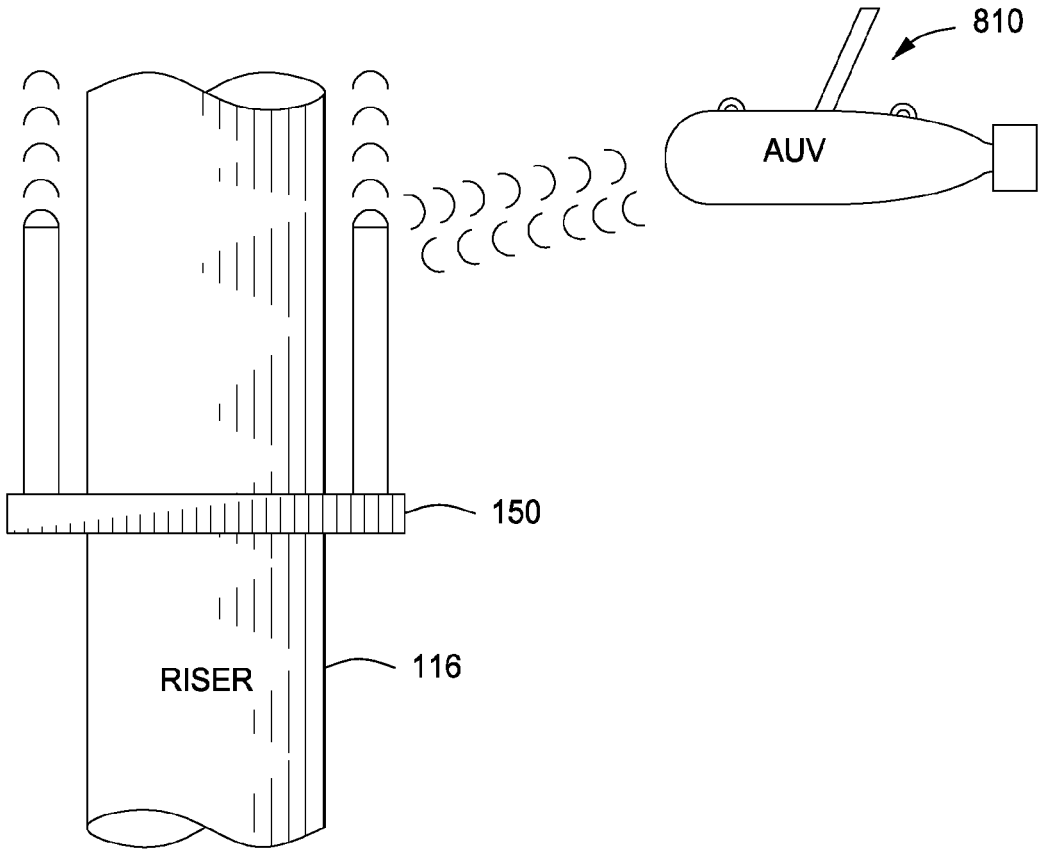
FIG. 8 depicts a schematic side view of an illustrative autonomous underwater vehicle communicating with a transponder coupled to the riser, according to one or more embodiments disclosed.

FIG. 8 depicts a schematic side view of an illustrative autonomous underwater vehicle ("AUV") 810 communicating with a transponder 150 coupled to the riser 116, according to one or more embodiments. The transponder 150 may act as a communications hub for the autonomous underwater vehicle 810 or other acoustic devices disposed on the sea floor 120. For example, data from the surface, such as a new mission profile or reprogramming information may be transmitted from the surface to the transponder 150 via acoustic pulses or a cable, and the transponder 150 may then transmit this data to the autonomous underwater vehicle 810 via acoustic pulses. In another example, data or video from the autonomous underwater vehicle 810 may be transmitted to the transponder 150 via acoustic pulses, and the transponder 150 may then transmit this data to the surface operator station 134 via acoustic pulses or a cable. In at least one embodiment, the transponder 150 may act as a communications hub between the autonomous underwater vehicle 810 and the downhole tool 126.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via another element or member." The terms "hot" and "cold" refer to relative temperatures to one another.

Although the preceding description has been described herein with reference to particular means, materials, and embodiments, it is not intended to be limited to the particulars disclosed herein; rather, it extends to all functionally equivalent structures, methods, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A system for communicating between a downhole tool and a surface location, comprising:

a downhole tool disposed on a tubing string within a subsea riser, wherein the downhole tool includes at least one device that actuates between first and second positions, wherein one of the at least one device comprises a latch that couples the downhole tool to the tubing string;

an internal transducer coupled to the downhole tool and adapted to transmit wirelessly a signal indicative of the position of the device, the internal transducer being located within the subsea riser;

an external transducer positioned on an exterior of the subsea riser, wherein the external transducer receives the signal wirelessly from the internal transducer through the subsea riser; and a transponder positioned on an exterior of the subsea riser and coupled to the external transducer, wherein the transponder is adapted to transmit a signal to a surface location indicative of the position of the at least one device.

2. The system of claim 1, wherein one of the at least one device comprises a valve disposed within the downhole tool.

3. The system of claim 1, wherein the signal from the internal transducer indicates whether the latch is coupling the downhole tool to the tubing string or whether the latch has released the downhole tool from the tubing string.

4. The system of claim 1, further comprising a plurality of external transducers that are circumferentially offset from one another around the riser.

5. The system of claim 1, further comprising a plurality of external transducers that are axially offset from one another and parallel to a centerline through the riser.

6. The system of claim 1, further comprising a clamp that secures the external transducer to the exterior of the riser.

7. The system of claim 1, further comprising one or more lines positioned radially-outward from the riser, wherein the one or more lines are selected from the group consisting of a choke line, a kill line, a boost line, and a hydraulic line, and wherein the clamp and the external transducer are positioned radially-inward from the one or more lines.

8. The system of claim 1, wherein the external transducer is coupled to a remotely operated vehicle that is adapted to position the external transducer radially-outward from the internal transducer.

9. The system of claim 1, wherein the signal from the transponder is wireless.

10. A method for communicating between a downhole tool and a surface location, comprising:

running a downhole tool into a subsea riser, wherein the downhole tool includes a device that actuates between a first position and a second position, and wherein the device comprises a valve or a latch;

detecting the position of the device with a sensor;

communicating data from the sensor to an internal transducer positioned within the subsea riser; and transmitting a signal from the an internal transducer coupled to the downhole tool to an external transducer positioned on an exterior of the subsea riser, wherein the signal from the internal transducer is indicative of the position of the device.

11. The method of claim 10, wherein the signal from the internal transducer transponder comprises an acoustic signal.

12. The method of claim 10, further comprising coupling the external transducer to the exterior of the riser with a remotely operated vehicle.

13. The method of claim 10, further comprising:

transmitting a signal from the external transducer to a transponder positioned on an exterior of the riser, wherein the signal from the external transducer is indicative of the position of the device; and transmitting a signal from the transponder to a surface location, wherein the signal from the transponder is indicative of the position of the device.

14. The method of claim 10, further comprising:

transmitting a signal from the external transducer to a remotely operated vehicle positioned on an exterior of the riser, wherein the signal from the external transducer is indicative of the position of the device; and transmitting a signal from the remotely operated vehicle to a surface location via a tether line coupled to the remotely operated vehicle, wherein the signal from the remotely operated vehicle is indicative of the position of the device.

15. A method for communicating between a downhole tool and a surface location, comprising:

running a downhole tool into a subsea riser, wherein the downhole tool includes a device that actuates between a first position and a second position;

placing an internal transducer, located within the subsea riser, in communication with a sensor monitoring the device;

positioning an external transducer about an exterior of the subsea riser with a remotely operated vehicle; and transmitting a signal from the an internal transducer coupled to the downhole tool through the subsea riser and to the external transducer, wherein the signal from the internal transducer is indicative of the position of the device.

16. The method of claim 15, wherein the external transducer is coupled to a clamp, and further comprising positioning the clamp about the exterior of the riser with the remotely operated vehicle.

17. The method of claim 16, wherein one or more lines are positioned radially-outward from the riser, and further comprising positioning the clamp and the external transducer radially-inward from the one or more lines.

18. The method of claim 17, wherein the one or more lines are selected from the group consisting of a choke line, a kill line, a boost line, and a hydraulic line.

19. The method of claim 18, further comprising:

transmitting a signal from the external transducer to a transponder positioned on an exterior of the riser, wherein the signal from the external transducer is indicative of the position of the device; and transmitting a signal from the transponder to a surface location, wherein the signal from the transponder is indicative of the position of the device.

* * * * *